US006578792B2

(12) United States Patent
Dommer

(10) Patent No.: US 6,578,792 B2
(45) Date of Patent: Jun. 17, 2003

(54) RUDDER BLADE MOUNTING ARRANGEMENT FOR A MISSILE

(75) Inventor: Josef Dommer, Nuremberg (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 10/116,532

(22) Filed: Apr. 4, 2002

(65) Prior Publication Data

US 2002/0148927 A1 Oct. 17, 2002

(30) Foreign Application Priority Data

Apr. 12, 2001 (DE) ..... 101 18 216

(51) Int. Cl.[7] ..... F42B 10/64; F42B 10/14; B64C 5/10

(52) U.S. Cl. ..... 244/3.24; 244/3.27; 244/3.28; 244/3.29; 244/49

(58) Field of Search ..... 244/3.24, 3.27–3.29, 244/49

(56) References Cited

U.S. PATENT DOCUMENTS

| | | | | | |
|---|---|---|---|---|---|
| 3,117,520 | A | * | 1/1964 | Kerr et al. | 244/3.24 |
| 3,880,383 | A | * | 4/1975 | Voss et al. | 244/3.27 |
| 3,918,664 | A | * | 11/1975 | Grosswendt | 244/3.28 |
| 4,660,786 | A | * | 4/1987 | Brieseck et al. | 244/3.24 |
| 4,709,877 | A | * | 12/1987 | Goulding | 244/3.28 |
| 4,728,058 | A | * | 3/1988 | Brieseck et al. | 244/3.28 |
| 5,042,749 | A | * | 8/1991 | Jacques et al. | 244/49 |
| 5,211,357 | A | * | 5/1993 | Leidenberger | 244/3.28 |
| 5,584,448 | A | * | 12/1996 | Epstein et al. | 244/3.28 |
| 6,186,443 | B1 | * | 2/2001 | Shaffer | 244/49 |
| 6,202,958 | B1 | * | 3/2001 | Dommer et al. | 244/3.28 |
| 6,220,544 | B1 | * | 4/2001 | Dommer et al. | 244/3.28 |
| 6,398,156 | B2 | * | 6/2002 | Hetzer et al. | 244/3.24 |

FOREIGN PATENT DOCUMENTS

| | | | | |
|---|---|---|---|---|
| DE | 34 41 534 C2 | | 5/1986 | |
| DE | 35 07 677 C2 | | 9/1986 | |
| DE | 43 35 785 A1 | | 4/1995 | |
| DE | 44 42 461 A1 | | 6/1995 | |
| GB | 1602-338 | * | 11/1981 | 244/3.27 |
| GB | 2238856 | * | 6/1991 | 244/3.27 |
| JP | 6-3096 | * | 11/1994 | 244/3.24 |

* cited by examiner

*Primary Examiner*—Michael J. Carone
*Assistant Examiner*—Lulit Semunegus
(74) *Attorney, Agent, or Firm*—Scully, Scott, Murphy & Presser

(57) ABSTRACT

Described is a rudder blade mounting arrangement (10) for a missile comprising a rudder blade (12) and a mounting element (16) for the rudder blade. The rudder blade (12) is displaceable about a rudder blade axis member (36) of the mounting element (16) between a retracted inactive position and a deployed active position. The rudder blade foot (14) of the rudder blade (12) is connected in positively locking relationship to the rudder blade axis member (36) in such a way that, in the deployed active position of the rudder blade (12), the rudder blade foot (14) is forced against a front face (62) of a side portion (24) of the mounting element (16). In the retracted inactive position the rudder blade foot (14) is spaced from said front face (62) by the positively locking connection and the rudder blade foot (14) is thus axially limitedly movable with the rudder blade axis member (36) in relation to the mounting element (16) so that the rudder blade (12) is freely displaceable from the retracted inactive position into the deployed active position.

8 Claims, 4 Drawing Sheets

RUDDER BLADE MOUNTING ARRANGEMENT FOR A MISSILE

BACKGROUND OF THE INVENTION

The invention concerns a rudder blade mounting arrangement for a missile, including a rudder blade and a mounting element which is provided for the rudder blade foot of the rudder blade and which has two mutually spaced side portions with mutually facing front faces defining a receiving space for the rudder blade foot, wherein there extends between the side portions through the receiving space a rudder blade axis member for the rudder blade which is displaceable between a retracted inactive position and a deployed active position.

DISCUSSION OF THE PRIOR ART

DE 43 35 785 A1 discloses a rudder control device for a projectile comprising a swingingly mounted control motor which, by way of a spindle, drives an entrainment nut by way of which a rudder shaft of the rudder blade is rotatable by way of an entrainment fork. In that known rudder control device, the control motor and the rudder shaft are mounted to a common carrier block which can be mounted in the projectile. The rudder shaft has a receiving means or mounting into which the rudder blade engages in positively locking relationship in the displacement direction. Provided between the rudder shaft and the entrainment fork is a connection which is in positively locking relationship in the displacement direction.

In known rudder blade mounting arrangements for missiles, which involves missiles which can be fired by means of a propellent charge, sensitivity in relation to fouling and contamination as occurs due to combustion residues is often something that cannot be avoided. Such contamination and fouling can affect operational reliability.

SUMMARY OF THE INVENTION

In consideration of those factors the object of the present invention is to provide a rudder blade mounting arrangement for a missile, of the kind set forth in the opening part of this specification, wherein sensitivity to fouling and contamination is eliminated and thus excellent operational reliability is guaranteed, that is to say ensuring rapid and reliable opening of the rudders disposed in a combustion chamber of a missile which can be fired by means of propellent charge.

In accordance with the invention, in a rudder blade mounting arrangement of the kind set forth in the opening part of this specification, that object is attained by the features of the characterising portion of claim 1. Preferred embodiments and developments of the rudder blade mounting arrangement according to the invention for a missile are characterised in the appendant claims.

By virtue of the fact that, in accordance with the invention, the axial spacing between the front faces of the two side portions of the mounting element of the rudder blade mounting arrangement is greater than the axial thickness dimension of the rudder blade foot, and by virtue of the fact that the rudder blade axis member is arranged between the two sides portions in axially limitedly movable fashion while being secured against rotation and the rudder blade foot is connected in positively locking relationship to the rudder blade axis member in such a way that in the deployed active position of the rudder blade the rudder blade foot is forced against the front face of the one side portion of the mounting element and in the retracted inactive position spaced by the positively locking connection from that front face and thus the rudder blade foot is axially limitedly movable with the rudder blade axis member relative to the mounting element and the rudder blade is consequently freely displaceable between the retracted inactive position and the deployed active position, that is to say it can be folded out, the arrangement affords excellent operational reliability as, in the event of dimensional alterations caused by temperature and gas pressure in respect of the axial thickness dimension of the rudder blade foot, as a result of the gap width between the two front faces of the side portions of the mounting element, a sufficient motion clearance is maintained at any time between the rudder blade foot and the mounting element so that deployment of the rudder is reliably guaranteed. As a result of the relatively great axial play between the rudder blade foot and the two side portions of the mounting element, this arrangement advantageously ensures that the arrangement is not susceptible to fouling and contamination as occurs due to combustion residues. Further advantages of the rudder blade mounting arrangement according to the invention involve the high positional accuracy of the deployed rudder blade because there is no clearance between the rudder blade and the mounting element in that active position, the inexpensive structure because the rudder blade mounting arrangement according to the invention comprises only a few parts, of simple configuration, involving low levels of tolerance demand, and the reduced level of friction so that, after leaving the muzzle of the bore, the respective rudder blade is deployed quickly and reliably, that is to say it is moved into the deployed, play-free active position. In addition the space required for the rudder blade mounting arrangement according to the invention is small. By virtue of the low tolerance requirements in respect of the parts of the rudder blade mounting arrangement according to the invention, that is to say the tolerance requirements in respect of the mounting element and the associated rudder blade, surface coating of said parts is advantageously not a problem.

BRIEF DESCRIPTION OF THE DRAWINGS

Further details, features and advantages will be apparent from the description hereinafter of an embodiment illustrated in the drawing of the rudder blade mounting arrangement according to the invention for a missile. In the drawing.

DETAILED DESCRIPTION OF A PREFERRED EMBODIMENT

Figure 1:
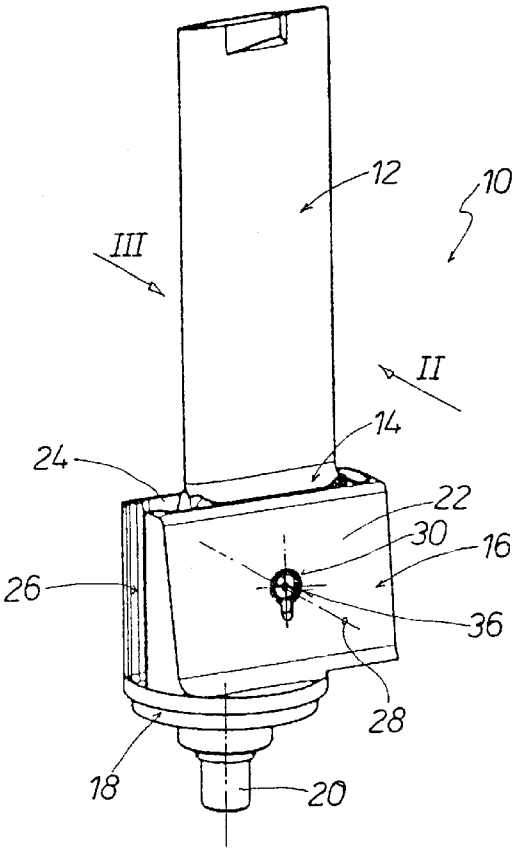
FIG. 1 is a perspective view of the rudder blade mounting arrangement.

FIG. 1 shows a rudder blade mounting arrangement 10 for a missile which can be fired from a weapon barrel by means of a propellent charge. The rudder blade mounting arrangement 10 has a rudder blade 12 with a rudder blade foot 14 and a mounting element 16 for the rudder blade 12. The mounting element 16 has a round base portion 18 from which a mounting projection or trunnion 20 centrally projects. The rudder blade 12 is displaceable about the trunnion 20, for steering the missile. Projecting from the base portion 18 on the side opposite to the trunnion 20 are two side portions 22 and 24 which are spaced from each other. The two side portions 22 and 24 are integrally connected together at one side. On the other side, the two side portions 22 and 24 are separated from each other by a slot 26.

The rudder blade 12 is pivotable in relation to the mounting element 16 about a pivot axis 28 between a retracted inactive position (not shown) and a deployed active position as shown in the drawing. In the retracted inactive position the rudder blade 12 extends through the slot 26.

Figure 3:
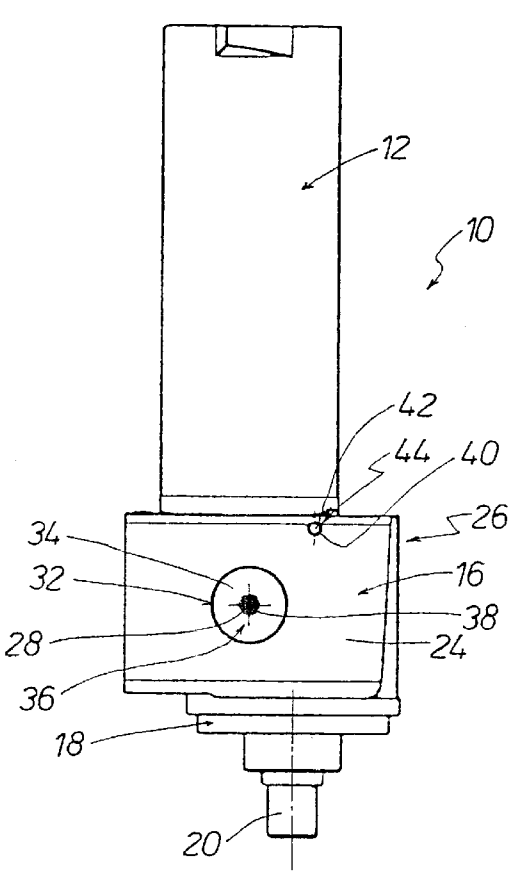
FIG. 3 is a side view of the rudder blade mounting arrangement of FIG. 1 from the other side, that is to say viewing in the direction of the arrow III.
Figure 2:
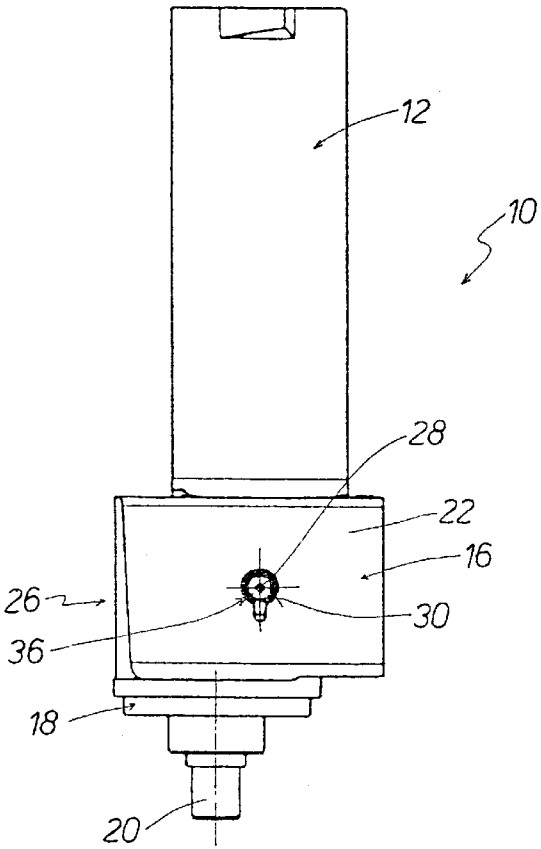
FIG. 2 is a side view of the rudder blade mounting arrangement of FIG. 1 viewing in the direction of the arrow II.

FIGS. 1 and 2 clearly show that the side portion 22 of the mounting element 16 is provided with a recess 30 which is associated with the pivot axis 28 and which deviates from a circular shape. FIG. 3 shows the side portion 24 of the mounting element 16 which is provided with a round blind hole 32 associated with the pivot axis 28, for a support flange 36 of a rudder blade axis member or spindle 36 for the rudder blade 12. The rudder blade axis member 36 is provided at its end with a blind hole 38 which deviates from a circular shape. For example, the blind hole 38 is of a configuration such as to afford a regularly hexagonal peripheral contour so that a socket-head wrench can be fitted into the blind hole 38.

FIG. 3 also shows a hole 40 in the side portion 24 of the mounting element 16 which is provided for an arresting element 42 of a resilient detent device 44. The rudder blade 12 is latched in the deployed active position with the mounting element 16 by means of the detent device 44.

Figure 4:
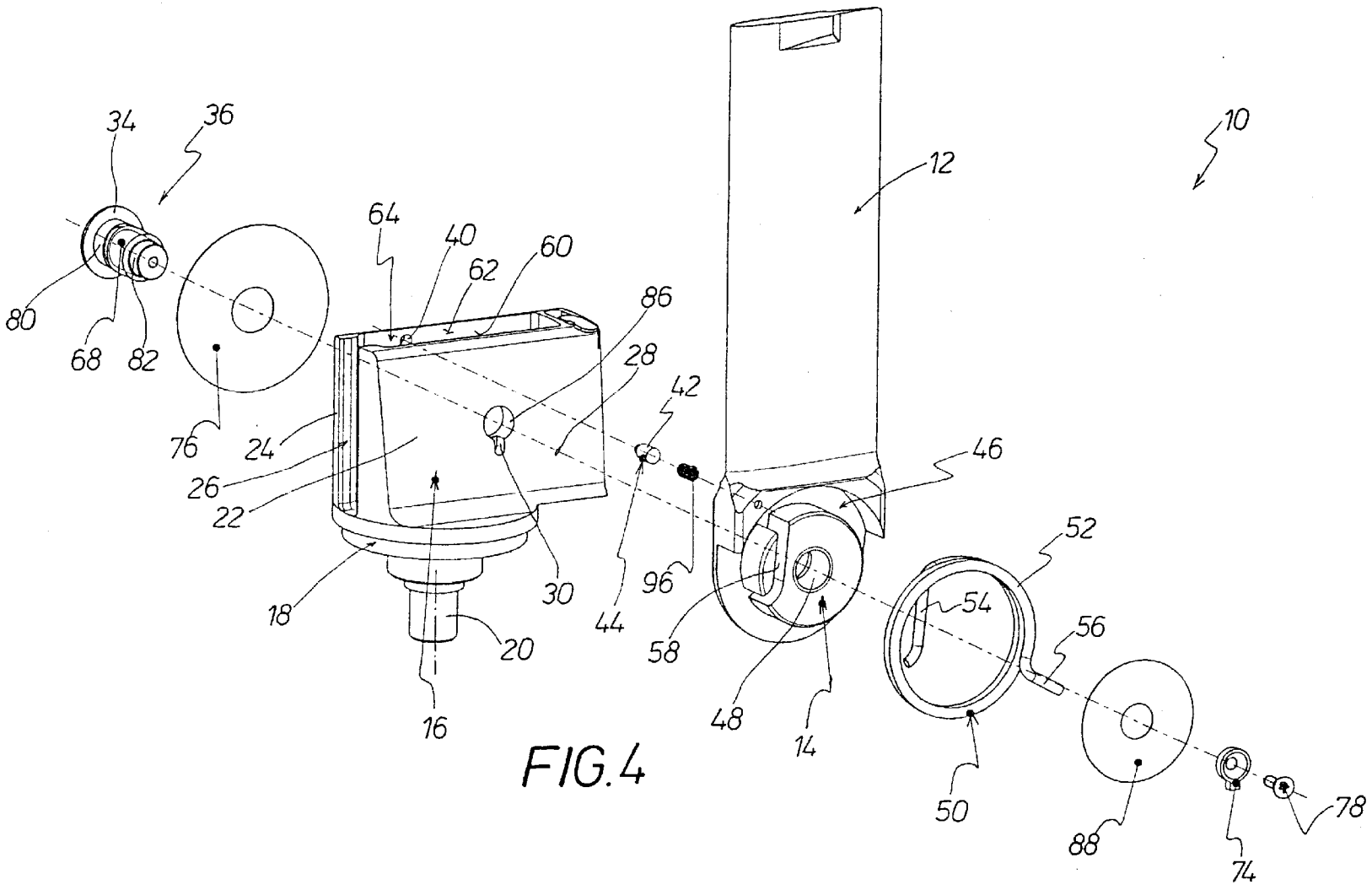
FIG. 4 is a perspective exploded view of the rudder blade mounting arrangement shown in FIGS. 1, 2 and 3.

FIG. 4 shows all individual parts of the rudder blade mounting arrangement 10 in an exploded perspective view with the rudder blade 12 and the mounting element 16 as well as with the further individual parts which are described in greater detail hereinafter.

The rudder blade foot 14 of the rudder blade 12 is provided at one side with an annular recess 46 which is in concentric relationship with a central bore 48 with a female screwthread therein. The annular recess 46 is intended to receive a deployment spring element 50. The deployment spring element 50 has at least one spring turn 52 and a first spring leg 54 and a second spring leg 56. The annular recess 46 in the rudder blade foot 14 serves to receive the at least one spring turn 52. A slot 58 in the rudder blade foot 14 serves to receive and fix the first spring leg 54 of the deployment spring element 50. The second spring leg 56 of the deployment spring element 50 is fixed in a hole (not shown) in the mounting element 16 of the rudder blade mounting arrangement 10.

Figure 5:
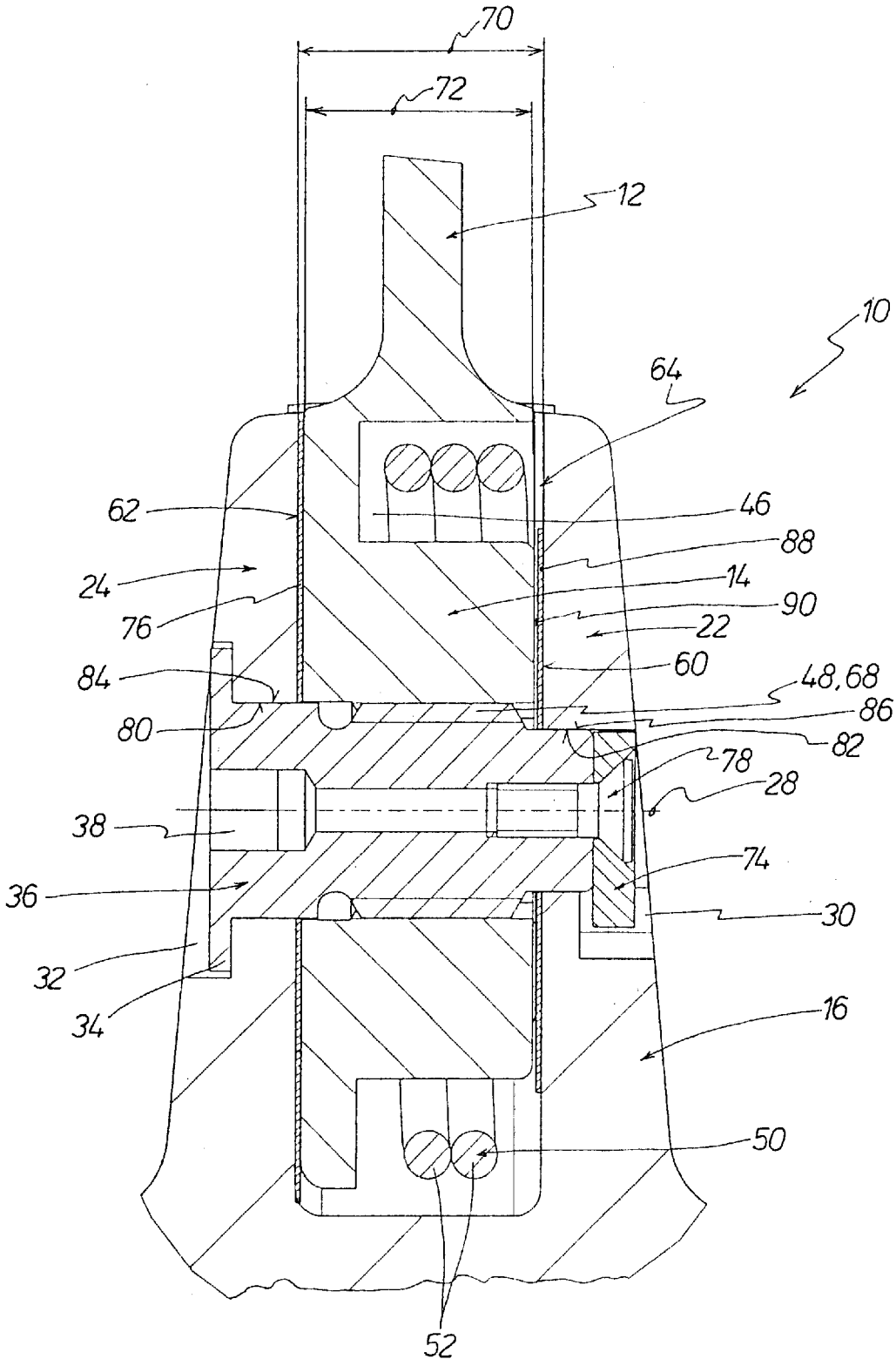
FIG. 5 is a sectional view of part of the rudder blade mounting arrangement of FIGS. 1 to 4.

As can also be seen from FIG. 5, the two mutually spaced side portions 22 and 24 have mutually facing front faces 60 and 62 which delimit a receiving space 64 for the rudder blade foot 14. Extending between the two side portions 22 and 24 of the mounting element 16, through the receiving space 64 is the rudder blade axis member or spindle 36 for the rudder blade 12 which is displaceable between a retracted inactive position and a deployed active position. The rudder blade axis member 36 is provided with a male screwthread portion 68 which is adapted to the bore 48 with the female screwthread in the rudder blade foot 14 of the rudder blade 12. The male screwthread portion 68 of the rudder blade axis member 36 and the internally screwthreaded bore 48 in the rudder blade foot 14 afford a positively locking connection between the rudder blade 12 and the rudder blade axis member 36 in such a manner that, in the deployed active position of the rudder blade 12, the rudder blade foot 14 is urged against the front face 62 of the side portion 24 and in the retracted inactive position it is axially spaced by said positively locking connection from that front face 62 and thus the rudder blade foot 14 is axially limitedly movable, with the rudder blade axis member 36, and consequently the rudder blade 12 is freely displaceable from the retracted inactive position into the deployed active position. For that purpose the axial spacing 70 (see FIG. 5) between the front faces 60 and 62 of the two side portions 22 and 24 of the mounting element 16 is greater than the axial thickness dimension 72 of the rudder blade foot 14. FIG. 5 also shows that the rudder blade axis member 36 is axially limitedly movable, between the two side portions 22 and 24 of the mounting element 16, while being secured to prevent rotational movement by means of a rotation-preventing element 74.

The positively locking connection between the rudder blade axis member 36 and the rudder blade foot 14 can be embodied for example by metric screwthreads 48, 68, by trapezoidal screwthreads or by suitably shaped depressions and raised portions, involving one or more pitch flights.

The rudder blade foot 14 is connected in positively locking relationship to the rudder blade axis member 36 by the male screwthread portion 68 of the rudder blade axis member 36 and the internally screwthreaded bore 48 of the rudder blade foot 14, in such a way that, in the deployed active position of the rudder blade 12, the rudder blade foot 14 is urged against the front face 62 of the side portion 24 and against a thrust ring element 76 associated with the side portion 24. That is implemented by adjustment by means of the rudder blade axis member 36. That affords a high level of positional accuracy for the rudder blade 12, in the deployed active position.

Adjustment of the rudder blade 12 is effected in the deployed active position thereof in that the rudder blade 12 or its rudder blade foot 14 is urged by a rotating screw actuation of the rudder blade axis member 36 against the thrust ring element 76 and against the front face 62 of the side portion 24 of the mounting element 16. For that purpose, a suitable tool is inserted into the blind hole 38 in the rudder blade axis member 36, which differs from a circular shape, that is to say it has a regularly hexagonal edge contour, and the rudder blade axis member 36 is rotated until the rudder blade foot 14 is forced against the thrust ring element 76 or the front face 62. The rotation-preventing element 74 is then fixed to the rudder blade axis member 36. That is effected for example by means of a screw element 78. The rudder blade axis member 36 is then secured to prevent rotation by means of the rotation-preventing element 74, but it is limitedly axially movable with respect to the mounting element 16. After that adjustment of the deployed rudder blade 12 in relation to the mounting element 16 the rudder blade 12 is pivoted into the retracted inactive position. When that happens, as a consequence of the positively locking connection, the rudder blade foot 14 performs a screw movement, that is to say an axial movement away from the thrust ring element 76 or the front face 62, so that the rudder blade 12 can now move limitedly freely axially in the receiving space 64 between the two side portions 22 and 24 of the mounting element 16. In that pivotal movement of the rudder blade 12 from the deployed active position into the retracted inactive position the deployment spring element 50 is mechanically stressed. After leaving the missile barrel the deployment spring element 50 can be relieved of stress again in order to displace the rudder blade 12 from the retracted inactive position into the deployed active position. Upon that deployment of the rudder blade 12 the rudder blade foot 14 is again forced against the thrust ring element 76 or the front face 62 of the side portion 24 of the mounting element 16 and thus the rudder blade 12 is connected to the mounting element 16 in positively locking relationship.

The rudder blade axis member 36 is provided with two mutually axially spaced cylindrical mounting portions 80 and 82 which are adapted to mounting bores 84 and 86 in the side portions 24 and 22 of the mounting element 16, with a sliding fit tolerance. At its one end the rudder blade axis member 36 is provided with the contact flange 34 and the blind hole 38 which deviates from the circular shape. The rotation-preventing element 74 is fixed at the opposite second end of the rudder blade axis member 36. The rotation-preventing element 74 is fixed in the recess 30 of the associated side portion 22 of the mounting element 16, the recess 30 being adapted in respect of shape to the rotation-preventing element 74.

A second thrust ring element 88 is provided between the rudder blade foot 14 and the front face 60 of the side portion 22 of the mounting element 16. A gap 90 is present in the deployed active position of the rudder blade 12 between the rudder blade foot 14 and the last-mentioned second thrust ring element 88.

The same details are identified in FIGS. 1 to 5 in each case by the same references so that there is no need for all features to be respectively described in detail, in relation to all those Figures.

Figure 6:
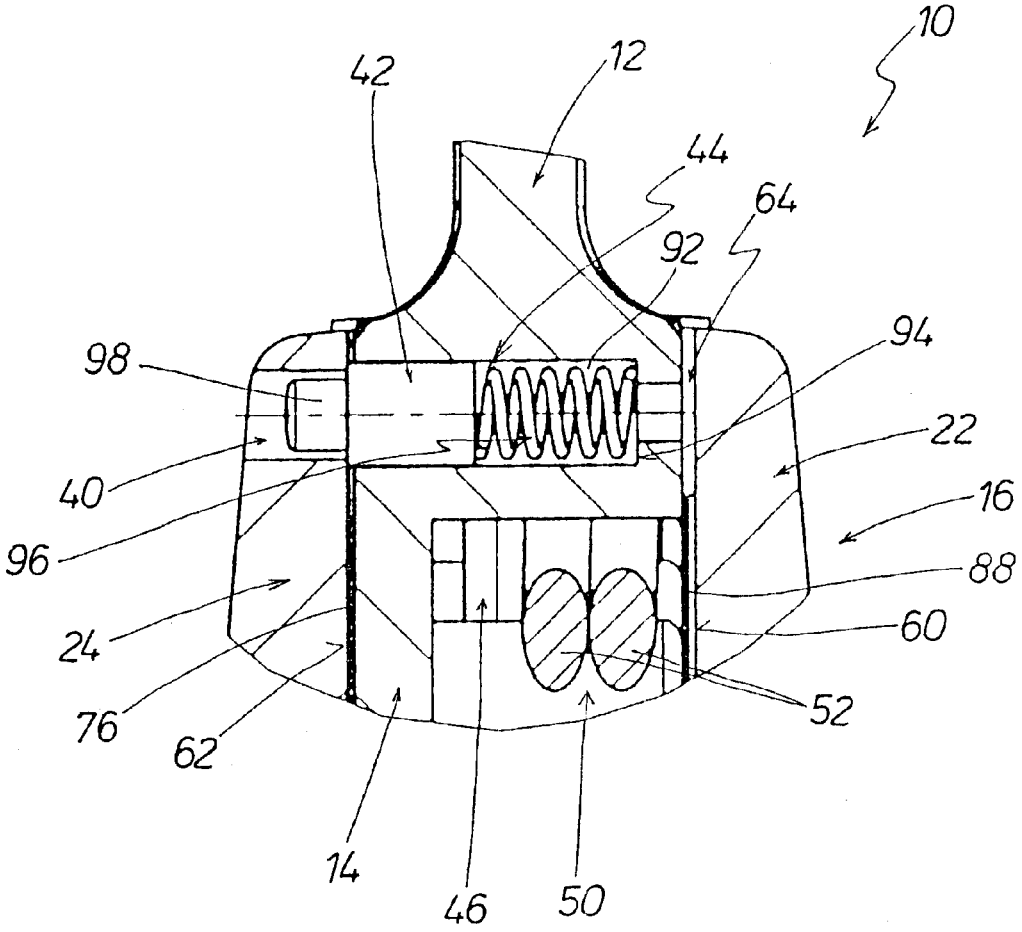
FIG. 6 is a sectional view of part of the rudder blade mounting arrangement for showing the resilient detent device for fixing the rudder blade in the deployed active position in relation to the mounting element.

FIG. 6 is a sectional view of a portion of the rudder blade 12 with its rudder blade foot 14 and part of the two side portions 22 and 24 of the mounting element 16 of the rudder blade arrangement 10, as well as a configuration of the resilient detent device 44, with which the rudder blade 12 is fixed in the deployed active position in relation to the mounting element 16. The rudder blade foot 14 is provided with a blind hole 92 in which the pin-shaped arresting element 42 is axially movably disposed. Arranged between the arresting element 42 and the bottom 94 of the blind hole 92 is an arresting spring element 96 which is mechanically stressed in the retracted inactive position of the rudder blade 12. The side portion 24 is provided with the hole 40 for the pin-shaped arresting element 42. In the deployed active position of the rudder blade 12 the pin-shaped arresting element 42 projects with a stepped front portion 98 of reduced cross-section into the hole 40 in order to fix the rudder blade 12 in the deployed active position. That is effected by relief of the stress of the arresting spring element 96.

Identical features are also identified in FIG. 6 by the same references as in FIGS. 1 to 5 so that there is no need for those features to be described in detail once again with reference to FIG. 6.

List of References

10 rudder blade mounting arangement
12 rudder blade (of 10)
14 rudder blade foor (of 12)
16 mounting element (of 10 for 14)
18 base portion (of 16)
20 mounting trunnion (of 16)
22 side portion (of 16)
24 side portion (of 16)
26 slot (between 24 and 26)
28 pivot axis (in 16 for 12)
30 recess (in 22 for 74)
32 blind hole (in 24 for 34)
34 contact flange (of 36)
36 rudder blade axis member (in 16 for 12)
38 blind hole (in 36)
40 hole (in 24 for 42)
42 arresting element (in 14)
44 detent device (for 12)
46 annular recess (in 14 for 50)
48 bore with female screwthread (in 14 for 36)
50 deployment spring element (for 12)
52 spring turn (of 50)
54 first spring leg (of 50)
56 second spring leg (of 50)
58 slot (in 14 for 54)
60 front face (of 22)
62 front face (of 24)
64 receiving space (between 60 and 62 for 14)
68 male screwthread portion (of 36)
70 axial spacing (between 60 and 62)
72 axial thickness dimension (of 14)
74 rotation-preventing element (on 36)
76 thrust ring element (between 14 and 62)
78 screw element (for 74)
80 mounting portion (of 36 in 24)
82 mounting bore (in 36 for 22)
84 mounting bore (in 24 for 80)
86 mounting bore (in 22 for 82)
88 second thrust ring element (between 14 and 60)
90 gap (between 14 and 88)
92 blind hole (in 14 for 42)
94 bottom (of 92)
96 arresting spring element (between 42 and 94)
98 front portion (of 42)

What is claimed is:

1. A rudder blade mounting arrangement for a missile, comprising a rudder blade (12) and a mounting element (16) which is provided for the rudder blade foot (14) of the rudder blade (12) and which has two mutually spaced side portions (22 and 24) with mutually facing front faces (60 and 62) by which a receiving space (64) for the rudder blade foot (14) is delimited, wherein extending between the side portions (22 and 24) through the receiving space (64) is a rudder blade axis member (36) for the rudder blade (12) which is displaceable between a retracted inactive position and a deployed active position, characterised in that the axial spacing (70) between the front faces (60 and 62) of the two side portions (22 and 24) is greater than the axial thickness dimension (72) of the rudder blade foot (14), and that the rudder blade axis member (36) is arranged between the two sides portions (22 and 24) in axial limitedly movable fashion while being secured against rotation and the rudder blade foot (14) is connected in positively locking relationship to the rudder blade axis member (36) in such a way that in the deployed active position of the rudder blade (12) the rudder blade foot (14) is forced against the front face (62) of the one side portion (24) and in the retracted inactive position spaced by the positively locking connection from said front face (62) and thus the rudder blade foot (14) is axially limitedly movable with the rudder blade axis member (36) and the rudder blade (12) is freely displaceable from the retracted inactive position into the deployed active position, and wherein the rudder blade mounting arrangement characterized in that at its one end the rudder blade axis member (36) has a contact flange (34) and a blind hole (38) which differs from a circular shape and that secured to an opposite second end of the rudder blade axis member (36) is a rotation-preventing element (74) which is provided in a recess (30) in the mounting element (16).

2. A rudder blade mounting arrangement according to claim 1 characterised in that rudder blade axis member (36) has a male screwthread portion (68) and that the rudder blade foot (14) has a female screwthreaded bore (48) which is adapted to the male screwthread portion (68), forming the positively locking connection between the rudder blade axis member (36) and the rudder blade foot (14).

3. A rudder blade mounting arrangement according to claim 1 characterised in that the rudder blade axis member (36) has two axially mutually spaced cylindrical mounting portions (80 and 82) and that the two side portions (22 and 24) of the mounting element (16) have mounting bores (86 and 84) adapted to the associated mounting portions (82 and 80).

4. A rudder blade mounting arrangement according claim 1 characterised in that a thin thrust ring element (88, 76) is provided in each case between the rudder blade foot (14) and the front faces (60 and 62) of the two side portions (22 and 24) of the mounting element (16).

5. A rudder blade mounting arrangement according to claim 1 characterised in that the rudder blade (12) is displaceable by means of a mechanically stressed deployment spring element (50) from the retracted inactive position into the deployed active position, which is fixed between the rudder blade foot (14) and the mounting element (16).

6. A rudder blade mounting arrangement according to claim 5 characterised in that the deployment spring element (50) is formed by a coil spring having at least one spring turn (52) and two spring legs (54 and 56), wherein the at least one spring turn (52) is arranged in an annular recess (46) in the rudder blade foot (14) and the one spring leg (54) is fixed in a slot (58) in the rudder blade foot (14) and the second spring leg (56) is fixed in a hole in the mounting element (16).

7. A rudder blade mounting arrangement according to claim 1 characterised in that the rudder blade (12) can be fixed on the mounting element (16) in the deployed active position of the rudder blade by means of a resilient detent device (44) provided in the rudder blade foot (14).

8. A rudder blade mounting arrangement according to claim 7 characterised in that the rudder blade foot (14) has a blind hole (92) in which are arranged an arresting element (42) and a mechanically biased arresting spring element (96) which form the detent device (44), and that one of the two side portions (24) of the mounting element (16) has a hole (40) into which the arresting element (42) projects with a stepped front portion (98) of reduced cross-section by means of the arresting spring element (96) in the deployed active position.

* * * * *